US005864741A

United States Patent [19]

Montfort et al.

[11] Patent Number: 5,864,741

[45] Date of Patent: Jan. 26, 1999

[54] SINGLE BRUSH CLEANER WITH COLLECTION ROLL AND ULTRASONIC CLEANING ASSIST

[75] Inventors: David B. Montfort, Webster; Nero R. Lindblad, Ontario, both of N.Y.

[73] Assignee: Xerox Corporation, Stamford, Conn.

[21] Appl. No.: 842,864

[22] Filed: Apr. 17, 1997

[51] Int. Cl.[6] ..... G03G 21/00

[52] U.S. Cl. ..... 399/349; 399/344; 399/353; 399/357

[58] Field of Search ..... 399/349, 353, 399/357, 354, 344; 15/256.51, 256.52

[56] References Cited

U.S. PATENT DOCUMENTS

| | | | |
|---|---|---|---|
| 4,111,546 | 9/1978 | Maret | 399/349 |
| 4,999,679 | 3/1991 | Corbin et al | 399/354 |
| 5,030,999 | 7/1991 | Lindblad et al. . | |
| 5,257,079 | 10/1993 | Lange et al. . | |
| 5,400,129 | 3/1995 | Lange et al. | 399/353 |
| 5,416,572 | 5/1995 | Kolb et al. | 399/350 |
| 5,500,969 | 3/1996 | Bonislawski, Jr. | 15/1.51 |
| 5,576,822 | 11/1996 | Lindblad et al. . | |
| 5,623,721 | 4/1997 | Lindblad et al. | 399/354 |
| 5,634,185 | 5/1997 | Lindblad et al. | 399/349 |
| 5,655,204 | 8/1997 | Siegel | 399/354 X |
| 5,659,849 | 8/1997 | Lindblad et al. | 399/349 X |
| 5,729,815 | 3/1998 | Lindblad et al. | 399/354 |
| 5,771,424 | 6/1998 | Lindblad | 399/354 X |

*Primary Examiner*—Matthew S. Smith
*Attorney, Agent, or Firm*—Zosan S. Soong

[57] ABSTRACT

An apparatus for efficient cleaning of the imaging surface. The primary cleaner is a rotating collection roll located directly opposite from and on the other side of the imaging surface from the ultrasonic cleaning assist device. The ultrasonic energy is used to remove the toner from the imaging surface enabling attraction toward the biased collection roll. The ultrasonic energy decreases the amount of residual toner remaining after transfer. The residual toner that is not cleaned from the surface by the collection roll is removed from the surface by the rotating biased conductive brush, which is the secondary cleaner. The collection roll is contactless in that it does not come into contact with the photoreceptor. In another embodiment of the invention, the primary cleaner and the secondary cleaner are collection rolls with ultrasonic cleaning assist devices directly under each collection roll. The entire cleaning system is contactless.

11 Claims, 7 Drawing Sheets

SINGLE BRUSH CLEANER WITH COLLECTION ROLL AND ULTRASONIC CLEANING ASSIST

BACKGROUND OF THE INVENTION

This invention relates generally to an electrostatographic printer and copier, and more particularly, to a cleaning apparatus for removing particles from an imaging surface.

Electrostatographic printers and copiers use various cleaner brushes to clean the imaging surface. For example a cleaner can be a mini dual ESB (i.e. electrostatic brush) that uses detoning rolls to remove the toner out of the brushes. While another imaging surface cleaner uses a large dual ESB with air detoning for removing particles from the imaging surface. The UMC (i.e. unit manufacturing cost) for the mini dual ESB is estimated at approximately one-third the cost of a large or standard size dual electrostatic brush cleaner. Most of the cost of a small ESB cleaner, however, is associated with the cost of the brushes, and the detoning rolls. In a multiple pass product, the mechanism needed to cam the brushes on and off the photoreceptor is an additional cost. For the large or standard sized ESB cleaner the major contributor to the UMC (i.e. unit manufacturing cost) is the air flow system required for detoning the brushes which is more than 50% of the cleaner cost.

The following disclosures may be relevant to various aspects of the present invention and may be briefly summarized as follows:

U.S. Pat. No. 5,576,822 to Lindblad et al. discloses an ultrasonic transducer located under the photoreceptor belt. The transducer provides vibrational energy to the surface to separate toner particles from the surface. The transducer is positioned such that it is located directly opposite the cleaning nip of the brush cleaner. The transducer reduces the adhesion of the toner to the photoreceptor surface, thereby allowing the brush to operate at reduced interference and voltage. The reduced interference and voltage results in toner being collected only at the very tips of the brush fibers thus, allowing more effective detoning of the brush.

U.S. Pat. No. 5,500,969 to Bonislawski, Jr. discloses a dual polarity commutated roll attracting toner and debris particles loosened into a particle cloud from the photoreceptor surface by an acoustical horn. The particles are attracted to and adhere to the commutated roll, whether right or wrong sign (i.e. positive or negative), and are removed from the roll, as the roll rotates, by a scraper blade. The particles are collected in a waste container as the particles are removed from the roll surface by the scraper blade. Residual particles that are not attracted to the commutated roll, are removed from the photoreceptor surface by a spots blade. The cleaning system does not contact the photoreceptor, thus, increasing cleaner and photoreceptor life.

U.S. Pat. No. 5,257,079 to Lange et al. discloses a cleaning brush electrically biased with an alternating current removes discharged particles from an imaging surface. The particles on the imaging surface are discharged by a corona generating device. A second cleaning device including an insulative brush, a conductive brush or a blade, located upstream of the first mentioned brush, in the direction of movement of the imaging surface, further removes redeposited particles therefrom.

U.S. Pat. No. 5,030,999 to Lindblad et al. discloses a piezoelectric transducer (PZT) device operating at a relatively high frequency coupled to the backside of a somewhat flexible imaging surface to cause localized vibration at a predetermined amplitude, and is positioned in close association with a cleaning enhancing electrostatic charging or discharging device associated with the imaging surface cleaning function, whereby residual toner and debris (hereinafter referred to as simply toner) is fluidized for enhance electrostatic discharge of the toner and/or imaging surface, and released from the mechanical forces adhering the toner to the imaging surface.

SUMMARY OF INVENTION

Briefly stated, and in accordance with one aspect of the present invention, there is provided an apparatus for removing particles from a moving surface after transfer of an image therefrom, comprising: a primary cleaning member for removing the particles from the surface, the primary cleaning member being continuously positioned away from contact with the surface including during removal of the particles from the surface; a vibrational device being located on the opposite side of the surface directly opposite the primary cleaning member; and a secondary cleaning member being located downstream, in the direction of motion of the surface from the primary cleaning member.

BRIEF DESCRIPTION OF THE DRAWINGS

Other features of the present invention will become apparent as the following description proceeds and upon reference to the drawings, in which.

DETAILED DESCRIPTION OF THE INVENTION

For a general understanding of a color electrostatographic printing or copying machine in which the present invention may be incorporated, reference is made to U.S. Pat. Nos. 4,599,285 and 4,679,929, whose contents are herein incorporated by reference, which describe the image on image process having multi-pass development with single pass transfer. Although the cleaning method and apparatus of the present invention is particularly well adapted for use in a color electrostatographic printing or copying machine, it should become evident from the following discussion, that it is equally well suited for use in a wide variety of devices and is not necessarily limited to the particular embodiments shown herein.

Figure 8:
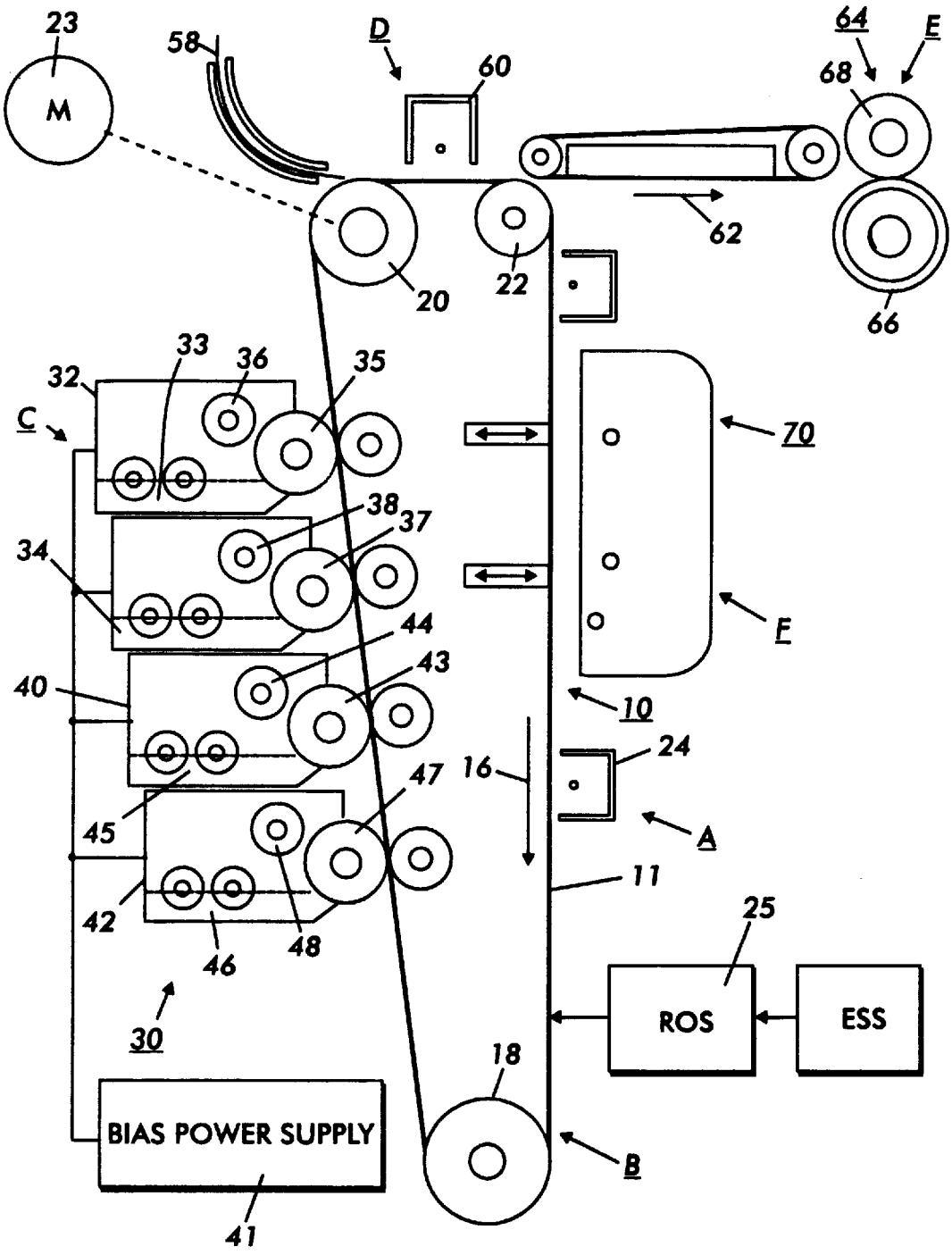
FIG. 8 is a schematic, elevational view of an electrostatographic printing machine incorporating the present invention; and While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Referring now to the drawings, where the showings are for the purpose of describing a preferred embodiment of the invention and not for limiting same, the various processing stations employed in the reproduction machine illustrated in FIG. 8 will be briefly described.

A reproduction machine, from which the present invention finds advantageous use, utilizes a charge retentive member in the form of the photoconductive belt 10 consisting of a photoconductive surface 11 and an electrically conductive, light transmissive substrate mounted for movement past charging station A, and exposure station B, developer stations C, transfer station D, fusing station E and cleaning station F. Belt 10 moves in the direction of arrow 16 to advance successive portions thereof sequentially through the various processing stations disposed about the path of movement thereof. Belt 10 is entrained about a plurality of rollers 18, 20 and 22, the former of which can be used to provide suitable tensioning of the photoreceptor belt 10. Motor 23 rotates roller 20 to advance belt 10 in the direction of arrow 16. Roller 20 is coupled to motor 23 by suitable means such as a belt drive.

As can be seen by further reference to FIG. 8, initially successive portions of belt 10 pass through charging station A. At charging station A, a corona device such as a scorotron, corotron or dicorotron indicated generally by the reference numeral 24, charges the belt 10 to a selectively high uniform positive or negative potential. Any suitable control, well known in the art, may be employed for controlling the corona device 24.

Next, the charged portions of the photoreceptor surface are advanced through exposure station B. At exposure station B, the uniformly charged photoreceptor or charge retentive surface 11 is exposed to a laser based input and/or output scanning device 25 which causes the charge retentive surface to be discharged in accordance with the output from the scanning device (for example, a two level Raster Output Scanner (ROS)).

The photoreceptor, which is initially charged to a voltage, undergoes dark decay to a voltage level. When exposed at the exposure station B it is discharged to near zero or ground potential for the image area in all colors.

At development station C, a development system, indicated generally by the reference numeral 30, advances development materials into contact with the electrostatic latent images. The development system 30 comprises first 42, second 40, third 34 and fourth 32 developer apparatuses. (However, this number may increase or decrease depending upon the number of colors, i.e. here four colors are referred to, thus, there are four developer housings.) The first developer apparatus 42 comprises a housing containing a donor roll 47, a magnetic roller 48, and developer material 46. The second developer apparatus 40 comprises a housing containing a donor roll 43, a magnetic roller 44, and developer material 45. The third developer apparatus 34 comprises a housing containing a donor roll 37, a magnetic roller 38, and developer material 39. The fourth developer apparatus 32 comprises a housing containing a donor roll 35, a magnetic roller 36, and developer material 33. The magnetic rollers 36, 38, 44, and 48 develop toner onto donor rolls 35, 37, 43 and 47, respectively. The donor rolls 35, 37, 43, and 47 then develop the toner onto the imaging surface 11. It is noted that development housings 32, 34, 40, 42, and any subsequent development housings must be scavengeless so as not to disturb the image formed by the previous development apparatus. All four housings contain developer material 33, 39, 45, 46 of selected colors. Electrical biasing is accomplished via power supply 41, electrically connected to developer apparatuses 32, 34, 40 and 42.

Sheets of substrate or support material 58 are advanced to transfer D from a supply tray, not shown. Sheets are fed from the tray by a sheet feeder, also not shown, and advanced to transfer D through a corona charging device 60. After transfer, the sheet continues to move in the direction of arrow 62, to fusing station E.

Fusing station E includes a fuser assembly, indicated generally by the reference numeral 64, which permanently affixes the transferred toner powder images to the sheets. Preferably, fuser assembly 64 includes a heated fuser roller 66 adapted to be pressure engaged with a back-up roller 68 with the toner powder images contacting fuser roller 66. In this manner, the toner powder image is permanently affixed to the sheet.

After fusing, copy sheets are directed to a catch tray, not shown, or a finishing station for binding, stapling, collating, etc., and removal from the machine by the operator. Alternatively, the sheet may be advanced to a duplex tray (not shown) from which it will be returned to the processor for receiving a second side copy. A lead edge to trail edge reversal and an odd number of sheet inversions is generally required for presentation of the second side for copying. However, if overlay information in the form of additional or second color information is desirable on the first side of the sheet, no lead edge to trail edge reversal is required. Of course, the return of the sheets for duplex or overlay copying may also be accomplished manually. Residual toner and debris remaining on photoreceptor belt 10 after each copy is made, may be removed at cleaning station F with a brush, blade or other type of cleaning system 70. A preclean corotron 160 is located upstream from the cleaning system 70.

Figure 1:
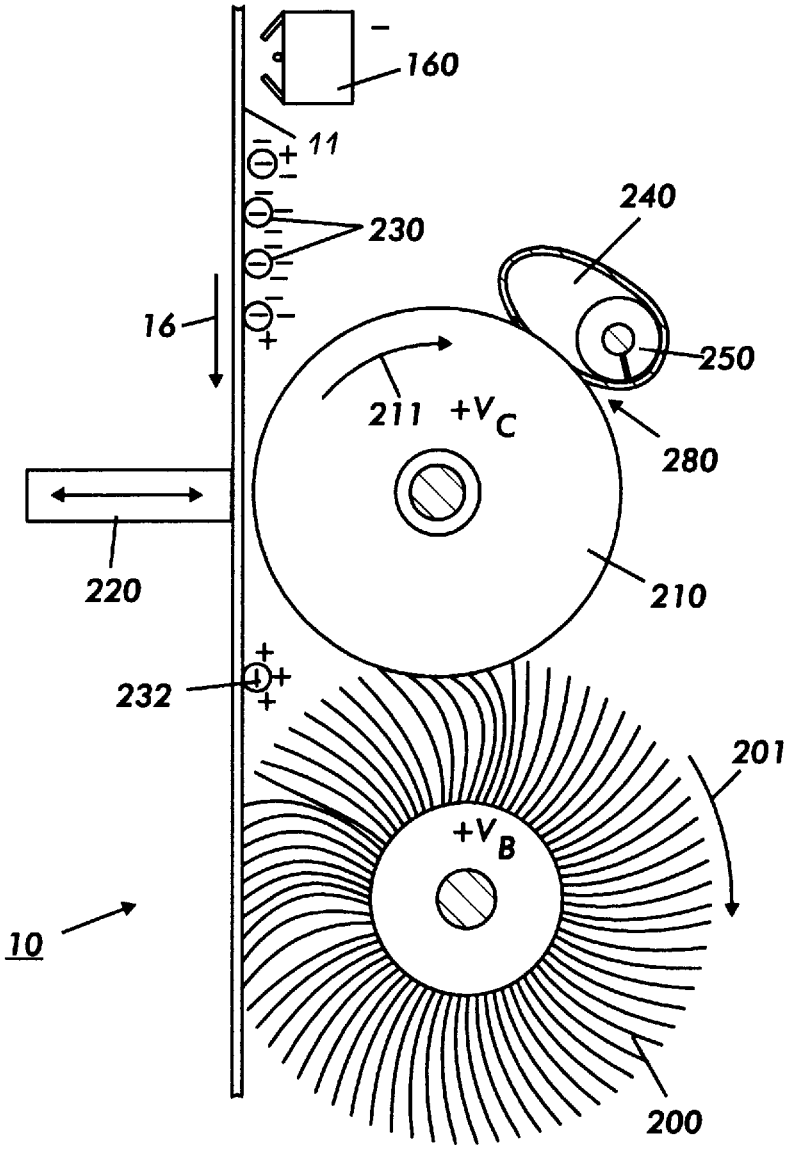
FIG. 1 is a schematic elevational view of the present invention using a positive biased collection roll and a positive biased cleaner brush.

Reference is now made to FIG. 1, which shows a schematic elevational view of the biased collection roll as the primary cleaner. A preclean corotron 160 is located upstream, in the direction of motion (shown by arrow 16) of the photoreceptor 10, from the biased collection roll 210. The present invention is applicable for both a negative preclean or a positive preclean, depending upon the triboelectric charging properties of the toner particles. The biased collection roll 210 is positioned out of contact with the photoreceptor surface 11. In the present invention, the spacing between the collection roll 210 and the photoreceptor can range from about 0.005" to about 0.012" (i.e. about 5 mils to about 12 mils). For this spacing, the ultrasonic tip velocity can range from 800 mm/sec to 1500 mm/sec. Larger spacing between the collection roll and the photoreceptor can occur in the present invention, but higher ultrasonic tip velocity would be required which can cause damage to the photoreceptor at tip velocities of about 2000 mm/sec. Alternatively, smaller spacing (which requires a lower ultrasonic tip velocity than larger spacings) is feasible if the spacing tolerance can be maintained in manufacturing.

With continuing reference to FIG. 1, an ultrasonic cleaning assist (UCA) 220 is positioned on the opposite side of the photoreceptor 10 from the collection roll 210, to assist in levitating (disturbing) particles remaining on the surface 11 after image transfer. The vertical motion of the UCA 220 contacts and retracts the UCA 220 from the photoreceptor 10. A biased conductive brush 200 is located downstream from the biased collection roll 210, in the direction of motion of the photoreceptor shown by arrow 16. A blade 280 scrapes the toner particles 230 off the collection roll 210 into a collection receptacle 240. (A metal blade was used experimentally as a scraping blade.) The collection receptacle 240 may contain an auger 250 to transport the toner particles 230 away.

With continuing reference to FIG. 1, the primary cleaner collection roll 210 removes the majority of the negatively charged residual toner 230 from the surface 11. However, a small amount of residual toner 232 may remain on the photoreceptor surface after cleaning by the collection roll 210. With a negative preclean treatment the toner 232 is negative as shown in Table 1. This negative toner is cleaned effectively with the positive biased brush.

Another embodiment occurs when there is no preclean treatment. (For example, removing the preclean 160 of FIG. 1.) In this instance, the residual toner 232 can be bipolar having equal amounts of positive and negative charged toners, or even slightly more positive toner than negative toner. At first it may appear that this toner would be difficult to clean with a positive brush. However, experimentation has shown that triboelectric negative toner, charged positively, can be cleaned with a positive brush provided that the charge density is less than 0.5 fc/micron and the toner mass density is less than 0.1 mg/cm$^2$. All the machine measurements of toner charge, after transfer, show that mainly all of the positive toner is less than 0.5 fc/micron because the negative triboelectric toner does not like to accept positive charge. U.S. patent application Ser. No. 08/622,978 is herein incorporated by reference that discloses the phenomenon of removing positively biased toner with a positively biased cleaner.

Figure 2:
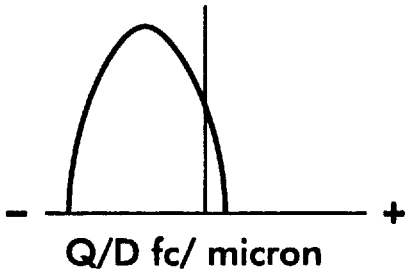
FIG. 2 is a graphical depiction of charge distribution for the toner after the preclean treatment.

The cleaner functions as follows—the toner, after negative preclean, is essentially completely negatively charged as shown in FIG. 2. The graphical depiction of FIG. 2 has a horizontal axis showing the ratio of charge (Q) on the toner particle to the diameter (D) of the toner particles. The units for the charge (Q) and the diameter (D) are femtocoulombs (fc) and microns, respectively. The vertical axis shows the number of particles that correspond to a specific Q/D ratio. In FIG. 2, the majority of the area under the graphical curve is on the negative side because of the negative preclean 160 (see FIG. 1) treatment. The negatively charged toner is dislodged from the photoreceptor as it enters the agitation zone of the UCA 220. The negative toner is captured by a positively biased collection roll 210 shown in FIG. 1. While the present invention is operable without a preclean, the negative preclean of FIG. 1 produces a more efficient transfer of toner from the photoreceptor to the collection roll.

Figure 3:
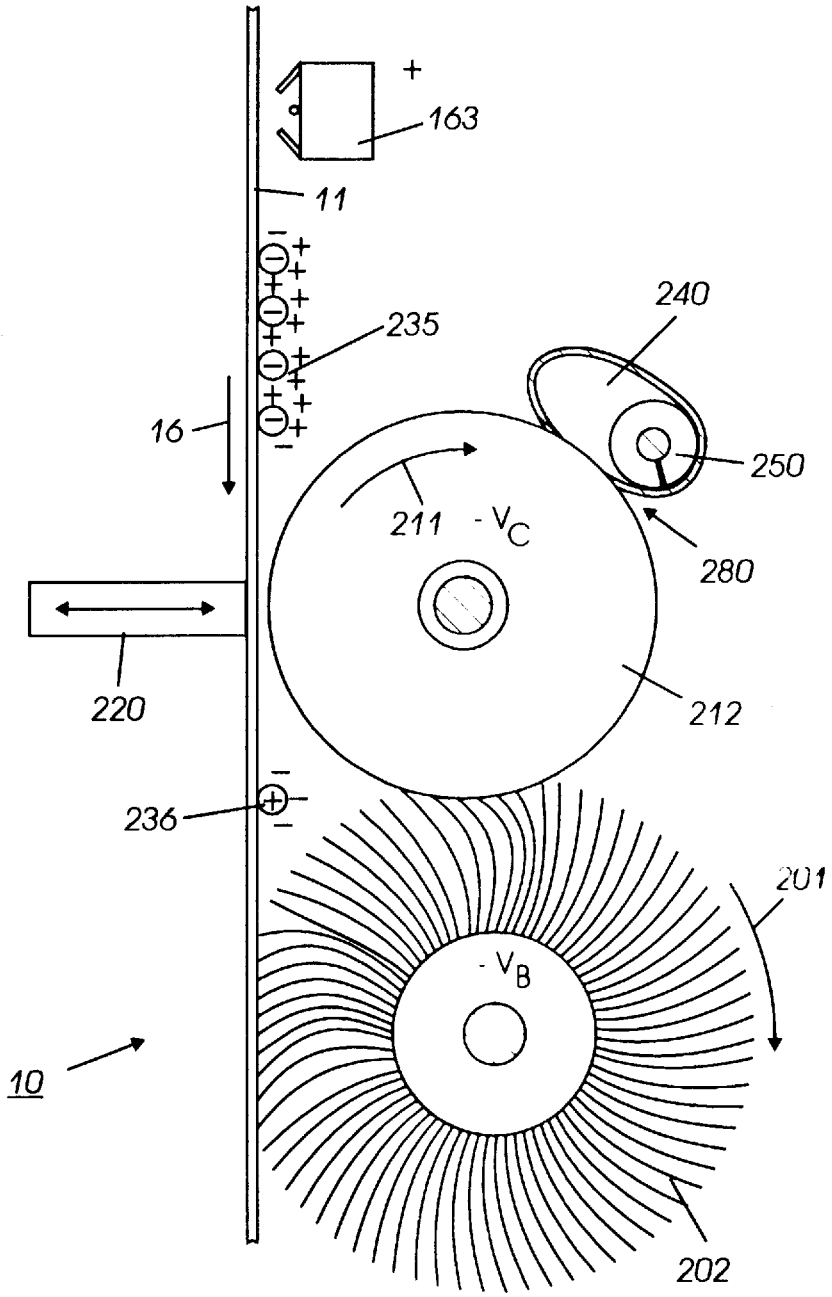
FIG. 3 is a schematic elevational view of the present invention using a negative biased collection roll and a negative biased cleaner brush.

Reference is now made to FIG. 3, which shows an alternately biased embodiment of the present invention. The toner particles are triboelectrically positive, and the bias of the collection roll 212 and brush 202 are negative to remove the particles 235, 236. A positive preclean treatment 163 is used in this cleaning system to increase attraction of the toner particles to the collection roll 212 and brush 202. However, this system is also operable without a preclean but, with less efficiency.

The present invention provides a cleaner that reduces the UMC while making the cleaning performance more robust than that of an electrostatic brush cleaning system. The UCA is located directly under the biased collection roll 210 in FIG. 1. The collection roll has similar electrical characteristics as the detoning roll for ESB detoning.

The effective cleaning ability of the collection roll, based on experimentation, is shown in Table 1 in the APPENDIX. Table 1 shows the percent cleaning efficiency for a collection roll bias of about 250 volts. The spacing between the collection roll and the photoreceptor was approximately six (6) mils for the experimental results of Table 1. Table 1 shows the mass and charge of the toner, before and after, the collection roll. Using both a low and high DMA (Developed Mass density per unit Area), the cleaning efficiency of the collection roll is relatively the same. Thus, showing that the UCA/biased collection roll combination is independent of the input mass. As shown in Table 1, the contactless collection roll is able to remove approximately 93% to 94% of the untransferred image mass. The remaining ~6%–7% of residual particles remaining on the surface are removed with the electrostatic brush.

Figure 4:
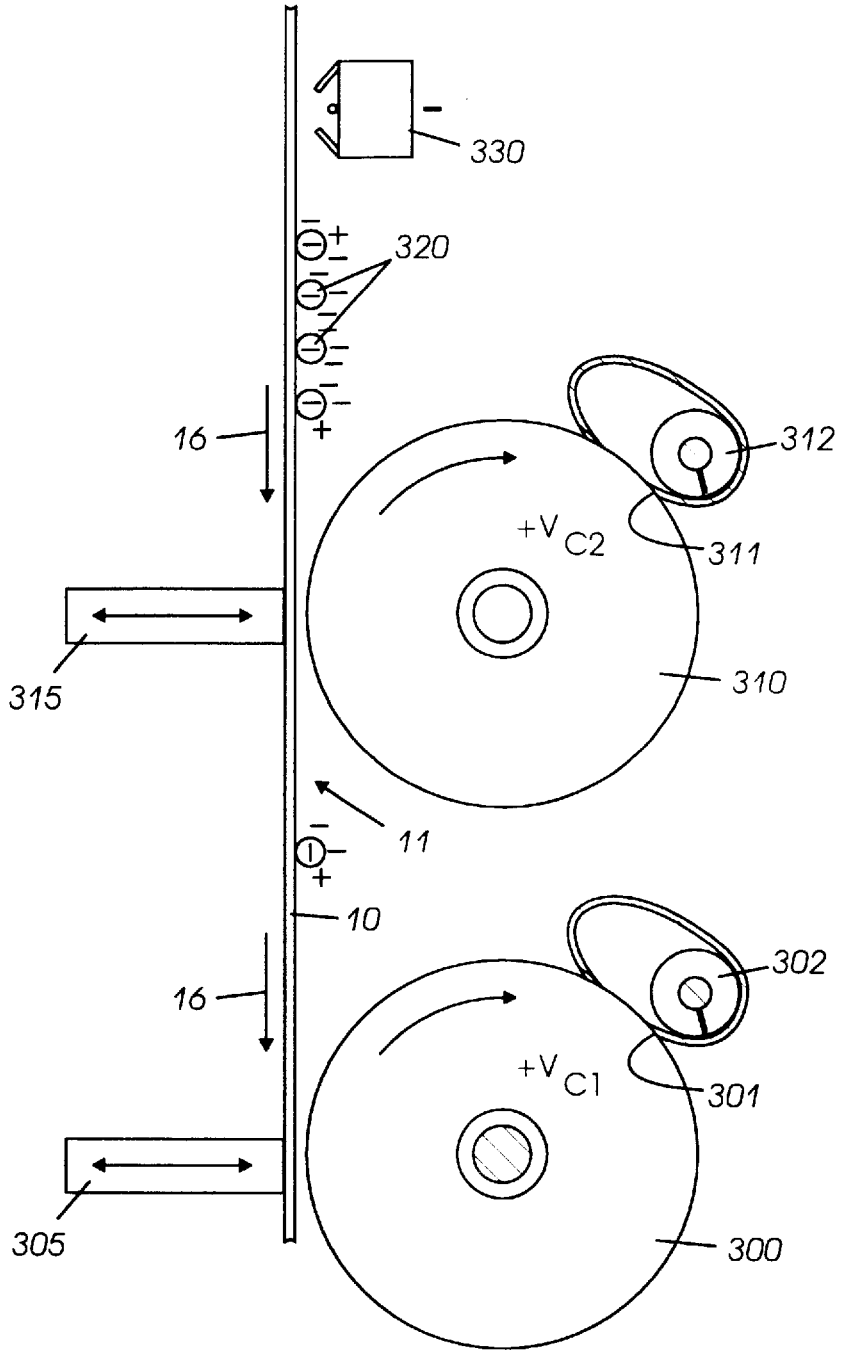
FIG. 4 is a schematic elevational view of an alternate embodiment of the present invention using a positively biased collection roll and a positively biased collection roll cleaner with preclean.

Reference is now made to FIG. 4, which shows another embodiment of the present invention that includes a dual collection roll cleaning system. This embodiment involves two biased collection rolls 300, 310 for capturing levitated toner 320, a scraper blade 301, 311 to remove the toner off of the rolls 300, 310, dual horn transducer or ultrasonic cleaning assist (UCA) 305, 315, to levitate the toner 320, and an auger system 302, 312 to transport the waste toner into a waste container (not shown). The UCAs 305, 315 are located directly under the biased collection rolls 300, 310. Examples of collection rolls include detoning rolls (anodized or ceramic), metallic rolls, conductive glass rolls, and conductive plastic rolls.

With continuing reference to FIG. 4, an embodiment of the present invention using a negative preclean is shown. This preclean 330 treatment produces a toner charge distribution that is predominantly negative. The negatively charged toner 320 is dislodged from the photoreceptor 10 when it enters the agitation zone, created by UCA 315, of the first collection roll 310. The toner 320 levitated by the UCA is attracted by the positively biased collection roll 310. The small amount of residual toner ($RMA_1$) left on the photoreceptor 10, after cleaning by the first collection roll 310, is still negatively charged as shown in FIG. 4. This residual toner is dislodged from the photoreceptor surface 11 by the second UCA 305 and captured by the positively biased second collection roll 300.

The experimental cleaning efficiency of the embodiment of the present invention, with a preclean of −10 $\mu$a, shown in FIG. 4 is summarized in Table 2. The input to the cleaner is shown in the column labeled "Cleaner Input". Note that the results are for both low and high DMA. The results after cleaning with the first collection roll are shown in the column labeled "Post Collection Roll 1". And, the residual mass detected after cleaning with the second collection roll is shown in the column labeled "Post Collection Roll 2". Table 2 shows that the first collection roll cleans about 93%–94% of the input toner, and the cleaning efficiency does not depend on the input mass density. Therefore, there is only a small amount of negative toner left on the photoreceptor for the second roll to clean which is momentarily dislodged by the second UCA for attraction to the second collection roll, as mentioned above.

Figure 5:
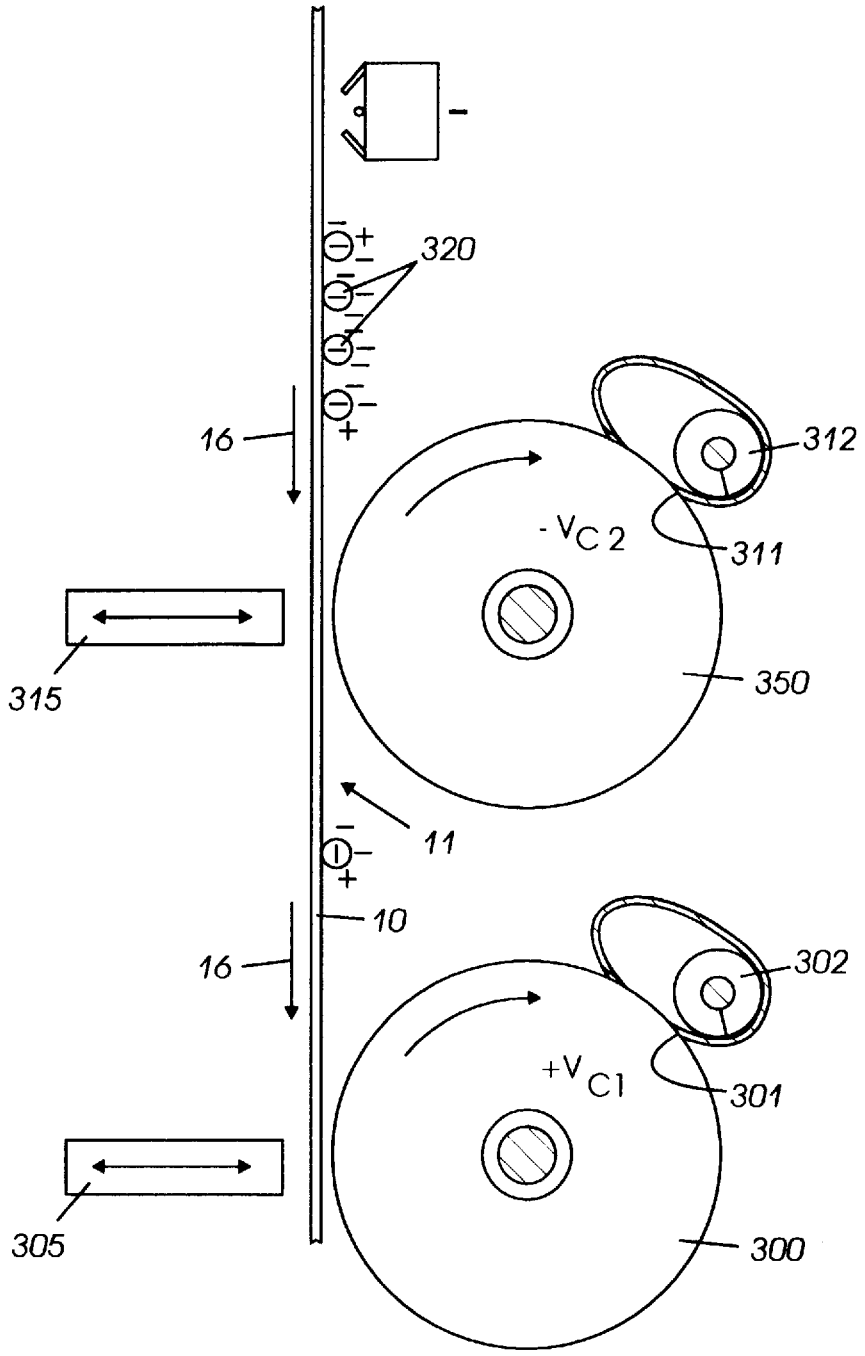
FIG. 5 is a schematic elevational view of an alternate embodiment of the present invention using a negatively biased collection roll and a positively biased collection roll cleaner.

Other experimental results of three other preclean/bias embodiments are shown in Tables 3–5. FIG. 5 shows the first of these three alternate experimental embodiments. In this embodiment, negative input toner was used but with a negative bias on the first collection roll. A negative preclean bias of −10 μa was applied to the toner. In this case, the negative input toner 320 was cleaned from the surface 11 with a biased negative collection roll 350. The results of the FIG. 5 embodiment are shown in Table 3. For the two input mass densities (low and high) the cleaning efficiency is less than 50%. A low cleaning efficiency was expected because the toner and the collection roll 350 are both negative limiting attraction of the toner to the collection roll 350. Due to the high residual mass density of toner remaining after the first collection roll 350, the second contactless collection roll 300 must remove the bulk of the residual toner remaining. Experimentally (see Table 3), the residual toner remaining on the photoreceptor 10 after cleaning by the second collection roll 300 was about 0.1 mg/cm$^2$ or less. This mass residual is too high, and indicates that the preclean and brush bias polarity are not correct.

Figure 6:
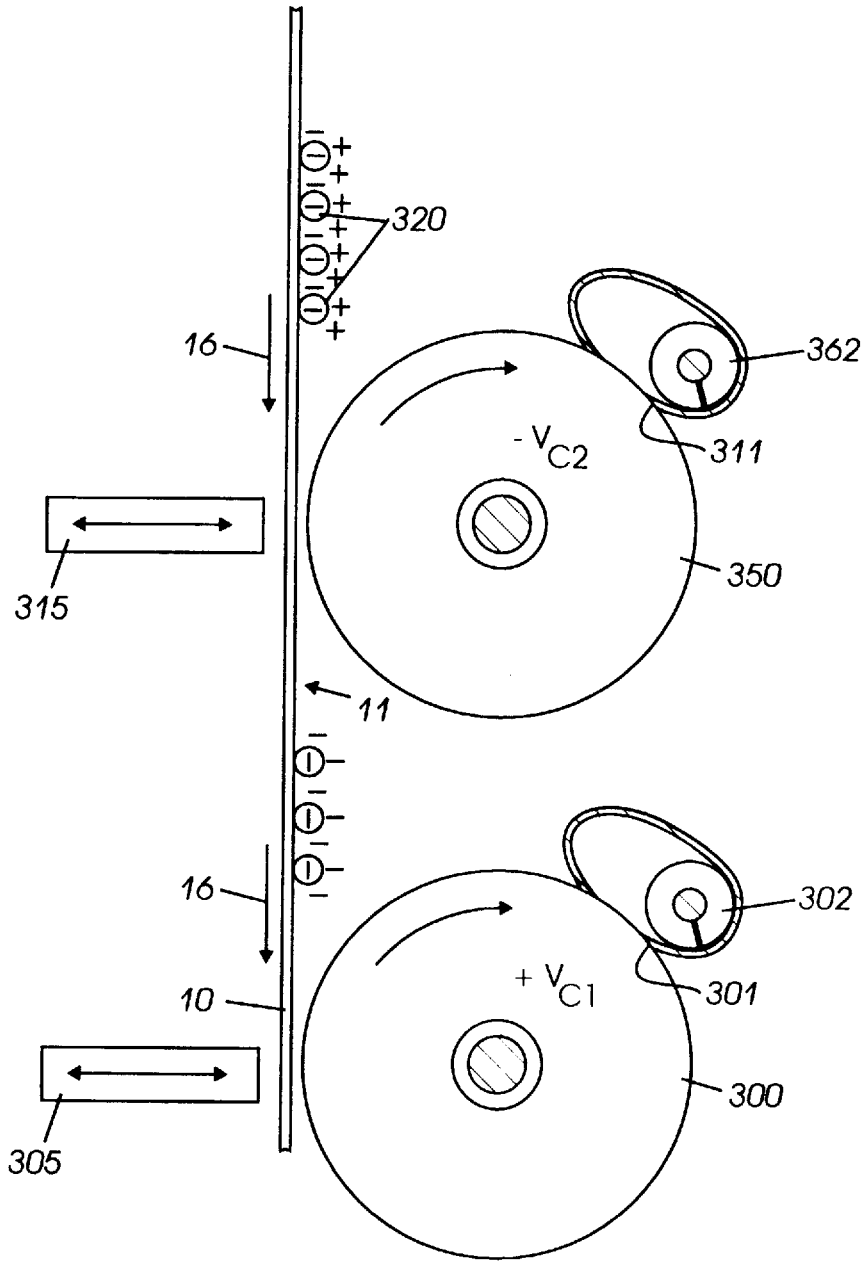
FIG. 6 is a schematic elevational view of an alternate embodiment of the present invention using a negatively biased collection roll and a positively biased collection roll cleaner without preclean.

Reference is made to FIG. 6 which shows the second of the three other experimental examples. In this example, the toner charge distribution simulates the toner charge left on the photoreceptor after transfer. This was achieved by treating the developed image with AC only. The resulting toner charge distribution tends to be centered around zero. These results are summarized in Table 4. (It is noted that the Q/M values shown in the tables represent approximately the center of the toner charge distribution.) In Table 4, the Q/M values for the input toner to the cleaner are shifted more positive so that toner charge distribution is skewed more to the positive side. Occasionally this does happen when the developed toner is treated with AC only. When the first collection roll is biased negative, this bias polarity does two things. First, it will clean some of the positive toner, and second it will inject negative charge into the toner. Thus, the toner after the first collection roll will be negative. In Table 4, it is observed that this charge injection is occurring. For example, the input toner to the first collection roll has an average charge of about +4 μcoul/gm, and after the first collection roll the average toner charge is about −8 μcoul/gm. This is actually an ideal phenomena because the positive bias of the second collection cleans this residual very easily leaving a residual mass $RMA_2$ of about 10 to 30 particles per mm$^2$.

It was experimentally observed that the residual toner ($RMA_1$) after the first collection roll is easier to clean than the input toner entering the first collection roll. This suggests that the $RMA_1$ adhesion to the photoreceptor is less than the input toner. However, this defies the idea that toner that is dislodged from the photoreceptor and returns to the photoreceptor is generally more difficult to remove. This fact is based on the "patch" theory, that charges tend to concentrate in localized areas on the toner particles. Thus, once a charge toner particle is dislodged off the photoreceptor, it returns to the photoreceptor with the high charge portion of the surface attaching to the photoreceptor creating a stronger electrostatic bond with the photoreceptor. Nevertheless, it has been found that the second collection roll cleans an equivalent mass density better than the first collection roll. It is believed that charge injection coupled with the ultrasonics cause this phenomenon. The bottom line, is that with the input conditions that are shown in Table 4, the photoreceptor is essentially clean after the dual collection roll cleaner station has been passed.

Figure 7:
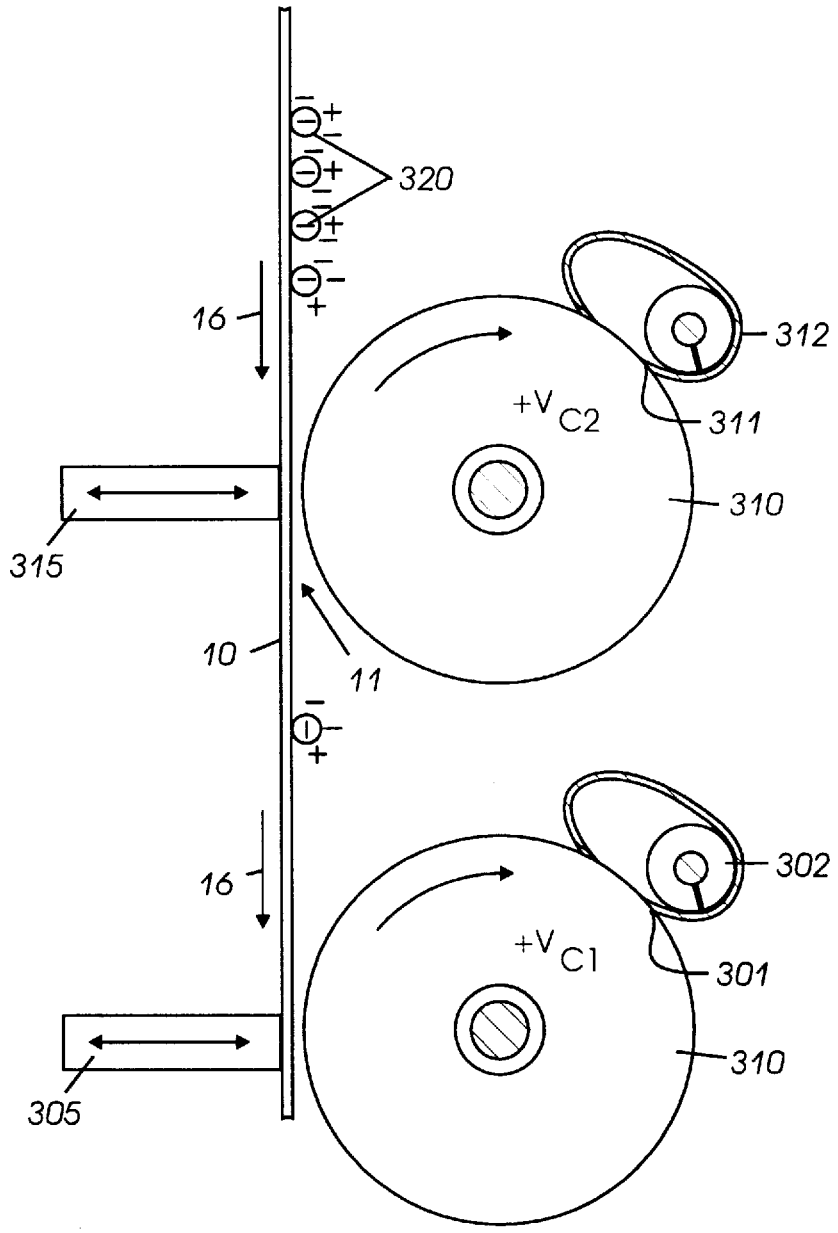
FIG. 7 is a schematic elevational view of an alternate embodiment of the present invention using a dual positively biased collection rolls without preclean.

In the third experimental embodiment, it was also for a simulated residual left after transfer with both collection rolls 300, 310 biased positively. This is depicted in FIG. 7. In this example, the first positive biased collection roll 310 cleans the negative toner and some of the positive toner. The input mass density and average toner charge is shown in the "cleaner Input" column of Table 5. This shows that the charge distribution is fairly closely centered around zero. The cleaning efficiency of the first collection roll 310 for the two mass densities is about 85%–88%. The second collection roll 300 reduces the residual toner after cleaning by the first collection 310 into a range that cannot be measured except by counting toner particles on the photoreceptor surface. The acceptable level for effective cleaning is less than 30 particles per mm$^2$.

Table 6 summarizes the cleaning results of the various embodiments of cleaner inputs/preclean treatments and bias polarities on the collection rolls shown in FIGS. 4–7. This table shows that the best cleaning performance is obtained in case 1 when the negative triboelectric toner, after transfer, is charged negatively and the bias on both collection rolls is positive. The collection rolls biased polarities work well for the removal of residual toner on the photoreceptor after a paper jam. This toner is mainly untransferred toner which has a high mass density and can be charged positively and negatively (see cases 3 and 4). In case 2, where the negative triboelectric toner is treated with a negative preclean and the bias on the first brush is negative, creating unacceptable cleaning efficiency. The cleaning efficiency or the transfer efficiency is too low and the mass density entering the second collection roll cannot be cleaned to the desired level of less than 30 particles per mm$^2$.

Additionally, for positive triboelectric toner a positive preclean treatment and a negative bias on the two collection rolls provides the best cleaning performance. Furthermore, the best polarity for the collections rolls would be negative in the instance where residual toner is treated with only an AC corona to simulate the charge on the toner after transfer.

The advantages of the present invention shown in FIGS. 1–3, include a primary cleaning element that does not contact the photoreceptor. In comparison to a dual ESB cleaner, the cleaner of the present invention reduces photoreceptor drag and abrasion because one brush has been eliminated. Also with ultrasonic assist, heavy toner densities of 1.0 mg/cm$^2$ or greater can be momentarily detached from the photoreceptor, and captured by the collection roll. This allows heavy toner densities, such as the control patches, or toner left on the photoreceptor after a paper jam to be cleaned in a single pass. Current dual ESB cleaners require two passes to clean these heavy densities which increases the machine down time and decreases the overall the machine print efficiency.

Additionally, cleaner life is improved due to the elimination of a primary brush to clean toner. In electrostatic brush cleaners the primary brush does most of the cleaning. The life of the primary brush is short due to the toner accumulation in the brush. This accumulation results in poor cleaning and thus requires replacement of the brush. Furthermore, as this toner accumulates in the brush, the toner emissions from the cleaner also increase. The collection roll as the primary cleaner in the present invention eliminates both these failure modes. The collection roll provides a marked improvement in cleaning, a marked reduction in cleaner cost (UMC), improved reliability and serviceability because their a fewer cleaning elements that last longer.

While a preclean device is not required for the present invention, the use of a preclean further increases the efficiency of the collection roll enabling slower rotation and less drag on the secondary brush cleaner for a better cleaning system.

In the embodiment of the present invention where both the primary and secondary cleaning elements are collection rolls (see FIGS. 4–7) that do not contact the photoreceptor surface, the cleaning elements do not create any drag or abrasion on the photoreceptor. Also, photoreceptor filming is reduced because there are no brushes to impact toner and additives onto the photoreceptor unlike the hybrid brush/collection roll embodiment of the present invention. With brush cleaners, there is a detoning step is not 100% efficient causing toner accumulation in the brush. The excess toner reduces the cleaning efficiency of the brush, the brush life, and increases toner emissions, serviceability and cleaner cost.

Furthermore, the dual collection rolls embodiment do not touch one another, therefore, the collection rolls can be biased with opposite polarities, such as in case 3 of Table 6.

Additionally, in the present invention, high mass densities on the photoreceptor can be cleaned in a single pass because the cleaning efficiency is independent of the toner mass density on the photoreceptor. Thus, when a paper jam occurs, most of the toner on the photoreceptor is the residual that was not transferred to the paper. The mass density of this toner is high, but still needs to be cleaned in a single pass, as in the present invention, to avoid multiple passes that decreases print output and revenue.

In recapitulation, the present invention is a primary collection roll cleaner with ultrasonic assist. The primary collection roll is contactless in that it does not come into contact with the photoreceptor. The primary cleaner is the collection roll with an ultrasonic cleaning assist that provides ultrasonic energy used to remove the toner from the photoreceptor toward the attraction of the biased collection roll. The ultrasonic energy decreases the amount of residual toner remaining after transfer. The residual toner that is not cleaned from the surface by the collection roll is removed from the surface by the secondary cleaner. This secondary cleaner can be a biased conductive brush or a second contactless collection roll with ultrasonic assist.

It is, therefore, apparent that there has been provided in accordance with the present invention, a primary cleaner of a collection roll with ultrasonic cleaning assist and a secondary cleaner that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

TABLE 1

APPENDIX
Percent Cleaning Efficiency for Collection Roll Bias Vc = 250 volts.
Spacing Between Collection Roll and Photoreceptor was 6 mils.

| Developed Image (Mass Input to Collection Roll) | | | | | | After Collection Roll (Residual after Collection Roll, and Mass input to Brush) | | | | | | % Cleaning Efficiency |
|---|---|---|---|---|---|---|---|---|---|---|---|---|
| M and Q | | | M and A | | | M and Q | | | M and A | | | |
| M mg | Q $10^{-7}$ $\mu c$ | Q/M $\mu c$/gm | M mg | A $cm^2$ | $DMA_{in}$ mg/$cm^2$ | M mg | Q $10^{-7}$ $\mu c$ | Q/M $\mu c$/gm | M mg | A $cm^2$ | $DMA_{out}$ mg/$cm^2$ | $(DMA_{in} - MA_{out}) \div DMA_{in}$ |
| 2.23 | −0.61 | −7.2 | 2.23 | 3.9 × 2.4 = 9.4 | 0.20 | 0.14 | −0.01 | −7.0 | 0.14 | 9.4 | 0.015 | 93 |
| 12.4 | −1.1 | −8.9 | 12.4 | 4.3 × 2.7 = 11.6 | 1.07 | 0.7 | −0.19 | −27 | 0.7 | 11.6 | 0.06 | 94 |

TABLE 2

Dual Collection Roll Cleaning for Negative Residual Toner Charge with Collection Roll Polarity (+, +)

| | Cleaner input (Post preclean) | | Post Collection Roll 1 | | | | Post Collection Roll 2 | |
|---|---|---|---|---|---|---|---|---|
| Preclean | DMA mg/$cm^2$ | Q/M $\mu$coul/gm | $V_{c2}$ volts | $RMA_1$ mg/$cm^2$ | $Q/M_1$ $\mu$coul/gm | % cleaning efficiency with primary roll | $V_{c1}$ | $RMA_2$ |
| lpc = −10 $\mu$a | 0.2 | −7.2 | +250 | 0.015 | −7.0 | 93% | +250 | "Zero" <30 particles per $mm^2$ |
| lpc = −10 $\mu$a | 1.07 | −8.9 | +250 | 0.06 | −27.6 | 94% | +250 | "Zero" < 3 0 particles per $mm^2$ |

TABLE 3

Dual Collection Roll Cleaning for Negative Residual Toner Charge with Collection Roll Polarity (−, +)

| | Cleaner input (Post preclean) | | Post Collection Roll 1 | | | % cleaning efficiency with | Post Collection Roll 2 | |
|---|---|---|---|---|---|---|---|---|
| Preclean | DMA mg/cm$^2$ | Q/M $\mu$coul/gm | $V_{c2}$ volts | $RMA_1$ mg/cm$^2$ | $Q/M_1$ $\mu$coul/gm | primary roll | $V_{c1}$ | $RMA_2$ |
| lpc = −10 $\mu$a | 0.3 | −3.3 | −250 | 0.30 | −9.1 | 23% | +250 | ≦0.1 |
| lpc = −10 $\mu$a | 1.4 | −5.9 | −250 | 0.73 | −7.1 | 48% | +250 | ≦0.1 |

TABLE 4

Dual Collection Roll Cleaning for Simulated Transferred Residual Toner Charge and with Collection Roll Polarity (−, +)

| | Cleaner input (Post preclean) | | Post Collection Roll 1 | | | % cleaning efficiency with | Post Collection Roll 2 | |
|---|---|---|---|---|---|---|---|---|
| Preclean | DMA mg/cm$^2$ | Q/M $\mu$coul/gm | $V_{c2}$ volts | $RMA_1$ mg/cm$^2$ | $Q/M_1$ $\mu$coul/gm | primary roll | $V_{c1}$ | $RMA_2$ |
| lpc = 0 (AC only) | 0.4 | −3.1 | −250 | 0.23 | −8.4 | 43% | +250 | "Zero" ≈10 to 30 particles mm$^2$ |
| lpc = 0 (AC only) | 1.2 | +4.52 | −250 | 0.46 | −7.9 | 62% | +250 | "Zero" ≈10 to 30 particles mm$^2$ |

TABLE 5

Dual Collection Roll Cleaning for Simulated Transferred Residual Toner Charge and with Collection Roll Polarity (+, +)

| | Cleaner input (Post preclean) | | Post Collection Roll 1 | | | % cleaning efficiency with | Post Collection Roll 2 | |
|---|---|---|---|---|---|---|---|---|
| Preclean | DMA mg/cm$^2$ | Q/M $\mu$coul/gm | $V_{c2}$ volts | $RMA_1$ mg/cm$^2$ | $Q/M_1$ $\mu$coul/gm | primary roll | $V_{c1}$ | $RMA_2$ |
| lpc = 0 (AC only) | 0.35 | +3.1 | +250 | 0.04 | −2.8 | 88% | +250 | "Zero" ≈10 to 30 particles mm$^2$ |
| lpc = 0 (AC only) | 0.93 | −1.6 | +250 | 0.14 | −5.7 | 85% | +250 | "Zero" ≈10 to 30 particles mm$^2$ |

TABLE 6

Summarizing the Cleaning Results for the Difference Toner Charge Distributions and Collection Roll Bias Polarities

| Cases | Preclean, or toner charge distribution | Collection roll bias polarity | Roll 1 Cleaning Efficiency Low DMA | Roll 1 Cleaning Efficiency High DMA | Roll 2 Cleaning Efficiency mg/cm$^2$ |
|---|---|---|---|---|---|
| 1 | lpc =−10 μa, toner charge distribution mainly negative | (+, +) | 93% | 94% | <30 particles/mm$^2$ |
| 2 | lpc =−10 μa, toner charge distribution mainly negative | (−, +) | 23% | 48% | ≦0.1 mg/cm$^2$ |
| 3 | lpc = 0, AC only, bipolar charge distribution | (−, +) | 43% | 62% | <30 particles/mm$^2$ |
| 4 | lpc = 0, AC only, bipolar charge distribution | (+, +) | 88% | 85% | <30 particles/mm$^2$ |

It is claimed:

1. An apparatus for removing particles from a moving surface after transfer of an image therefrom, comprising:

a primary cleaning member for removing the particles from the surface, wherein said primary cleaning member is singularly biased, said primary cleaning member being continuously positioned away from contact with the surface including during removal of the particles from the surface;

a first vibrational device being located on the opposite side of the surface directly opposite said primary cleaning member; and a secondary cleaning member being located downstream, in the direction of motion of the surface from said primary cleaning member, wherein said primary cleaning member is biased in a manner to remove the particles, having a charge thereon, from the surface, wherein said secondary cleaning member is biased in a manner to remove residual particles from the surface that remain on the surface, after cleaning by said primary cleaning member, further comprising a precleaning means to charge the particles remaining after transfer enabling more effective removal of the particles, wherein the particles are triboelectrically negative, wherein said primary cleaning member is positively biased, and wherein the residual particles having a positive charge thereon, from a bias of said primary cleaning member, are removed by the secondary cleaning member which is biased positively.

2. The apparatus as recited in claim 1, wherein said precleaning means is negatively biased.

3. An apparatus for removing particles from a moving surface after transfer of an image therefrom, comprising:

a primary cleaning member for removing the particles from the surface, wherein said primary cleaning member is singularly biased, said primary cleaning member being continuously positioned away from contact with the surface including during removal of the particles from the surface;

a first vibrational device being located on the opposite side of the surface directly opposite said primary cleaning member; and a secondary cleaning member being located downstream, in the direction of motion of the surface from said primary cleaning member, wherein said primary cleaning member is biased in a manner to remove the particles, having a charge thereon, from the surface, wherein said secondary cleaning member is biased in a manner to remove residual particles from the surface that remain on the surface, after cleaning by said primary cleaning member, further comprising a precleaning means to charge the particles remaining after transfer enabling more effective removal of the particles, wherein the particles are triboelectrically positive, wherein said primary cleaning member is negatively biased, and wherein the residual particles having a negative charge thereon, from a bias of said primary cleaning member, are removed by the secondary cleaning member which is biased negatively.

4. The apparatus as recited in claim 3, wherein said precleaning means is positively biased.

5. An apparatus for removing particles from a moving surface after transfer of an image therefrom, comprising:

a primary cleaning member for removing the particles from the surface, wherein said primary cleaning member is singularly biased, said primary cleaning member being continuously positioned away from contact with the surface including during removal of the particles from the surface;

a first vibrational device being located on the opposite side of the surface directly opposite said primary cleaning member; and a secondary cleaning member being located downstream, in the direction of motion of the surface from said primary cleaning member, wherein said primary cleaning member is biased in a manner to remove the particles, having a charge thereon, from the surface, wherein said secondary cleaning member is biased in a manner to remove residual particles from the surface that remain on the surface, after cleaning by said primary cleaning member, further comprising said secondary cleaning member being continuously positioned away from contact with the surface during removal of the particles from the surface and having a second vibrational device located on the opposite side of the surface directly opposite said secondary cleaning member, wherein said primary cleaning member comprises a first collection roll, wherein said secondary cleaning member comprises a second collection roll, wherein first collection roll and said second collection roll are positioned at least approximately 5 mils to approximately 12 mils away from the surface during cleaning of the surface, and wherein the particles have a bipolar charge distribution.

6. The apparatus as recited in claim 5, wherein said first collection roll is negatively biased.

7. The apparatus as recited in claim 6, wherein said second collection roll is positively biased.

8. The apparatus as recited in claim 5, wherein said first collection roll and said second collection roll are positively biased.

9. An apparatus for removing particles from a moving surface after transfer of an image therefrom, comprising:

a primary cleaning member for removing the particles from the surface, wherein said primary cleaning member is singularly biased, said primary cleaning member being continuously positioned away from contact with the surface including during removal of the particles from the surface;

a first vibrational device being located on the opposite side of the surface directly opposite said primary cleaning member; and a secondary cleaning member being located downstream, in the direction of motion of the surface from said primary cleaning member, and wherein said primary cleaning member comprises a first collection roll, said secondary cleaning member comprises a brush and the surface of the first collection roll contacts the brush.

10. The apparatus as recited in claim 9, further comprising a precleaning means to charge the particles remaining after transfer enabling more effective removal of the particles.

11. The apparatus as recited in claim 9, wherein said primary cleaning member is positioned at least approximately 5 mils to approximately 12 mils away from the surface during cleaning of the surface.

* * * * *